US006348895B1

(12) United States Patent
Tay et al.

(10) Patent No.: US 6,348,895 B1
(45) Date of Patent: Feb. 19, 2002

(54) PORTABLE RADIO COMMUNICATION DEVICE WITH IMPROVED ANTENNA RADIATION EFFICIENCY

(75) Inventors: Yew Siow Tay; Guan Hong Ng, both of Singapore (SG)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/625,527

(22) Filed: Jul. 26, 2000

(51) Int. Cl.[7] ..... H01Q 1/24
(52) U.S. Cl. ..... 343/702; 343/841; 455/89
(58) Field of Search ..... 343/700 MS, 702, 343/841; 455/89, 90

(56) References Cited

U.S. PATENT DOCUMENTS 5,508,709 A * 4/1996 Krenz et al. ..... 343/702
5,554,996 A * 9/1996 Chatzipetros ..... 343/702
5,821,902 A * 10/1998 Keen ..... 343/700 MS
6,031,494 A * 2/2000 Okabe et al. ..... 343/702
6,097,339 A * 8/2000 Filipovic et al. ..... 343/702

OTHER PUBLICATIONS

Tay, et al.; Dipole Configuration with Strongly Improved Radiation Efficiency for Hand–Held Transceivers; IEEE Transactions on Antennas and Propagation; vol. 46 No. 6, Jun. 1998, pp. 798–806.

* cited by examiner

*Primary Examiner*—Tan Ho
(74) *Attorney, Agent, or Firm*—Daniel Collopy; Roland K. Bowler, II

(57) ABSTRACT

A portable radio telephone (1) with improved antenna radiation efficiency. The radio telephone (1) has an antenna (5) asymmetrical about a feedpoint (9). A two part housing (3, 4) partially encloses the antenna (5) and an electrically conductive surface provides a reflector (10) for antenna (5), the reflector (10) having a length that is at least half a wavelength of an intended lowest operating frequency of the radio telephone (1).

22 Claims, 5 Drawing Sheets

PORTABLE RADIO COMMUNICATION DEVICE WITH IMPROVED ANTENNA RADIATION EFFICIENCY

FIELD OF THE INVENTION

This invention relates to a portable radio communication device with improved antenna radiation efficiency. The invention is particularly useful for, but not necessarily limited to, hand held battery powered portable radio telephones.

BACKGROUND ART

Portable radio communication devices such as hand held portable radio telephones, often called cellphones, mobile phones or handphones, are becoming a common and convenient form of communication. Users generally desire such communication devices to be compact and therefore battery size is a design consideration. If the battery size could be reduced without compromising talk time then the overall size of battery powered communication devices could be reduced. However, amongst other factors, talk time is dependent upon battery size. It would therefore be advantageous to improve antenna radiation efficiency of communication devices in order to reduce battery size without compromising talk time. Alternatively, if antenna radiation efficiency could be improved, then for a given type battery, talk time could be increased.

In Tay et al (Dipole configuration with strongly improved radiation efficiency for hand-held transceivers, IEEE Transactions on Antennas and Propagation, Vol. 46, pp. 798–806, June 1998) there is described a symmetrical antenna with improved radiation efficiency. The antenna has an associated reflector in the form of a wire. This symmetrical antenna is not ideally suited for portable radio communication devices, which typically use asymmetrical antennas. Further, the wire reflector only operates as a highly localized reflector, with perceived high current densities, and therefore does not provide a significant advantage for use with portable radio communication devices.

SUMMARY OF THE INVENTION

According to one aspect of the invention there is provided a portable radio communication device with improved antenna radiation efficiency, said radio communication device comprising:

an antenna asymmetrical about a feedpoint thereof;

a housing at least partially enclosing said antenna; and an electrically conductive surface providing a reflector for said antenna, said reflector having a length that is at least half a wavelength of an intended lowest operating frequency of said radio communication device.

Preferably, said antenna may have a stub portion extending from said housing.

Suitably, said antenna may have a ground plane portion associated with a circuit board enclosed in said housing, and wherein said feedpoint is between said stub portion and said ground plane portion.

Preferably, said reflector can be electrically floating relative to said ground plane.

Suitably, said reflector may be a conductive plate.

Preferably, said reflector can be disposed on said housing. Alternatively, said reflector may be integrally molded in said housing.

Suitably, said reflector may be disposed on a surface of said housing adjacent a speaker outlet thereof. Preferably, said reflector can be disposed on said surface and at least one side surface of said housing. If required, said reflector can disposed on every side surface of said housing to provide an electrically conductive shell.

In one preferable form, said reflector may be in the form of a meander strip. The meander strip can be configured so that electric field components of said antenna that are induced into said reflector are substantially summed in a direction parallel to a longitudinal of said ground plane portion and cancelled in an transverse axis that is transverse to said longitudinal axis.

Preferably, said reflector is in the form of meander strips having lengths parallel to each other. The meander strips can be suitably configured so that electric field components electric field components of said antenna that are induced into said reflector are substantially summed in a direction parallel to a longitudinal of said ground plane portion and cancelled in an transverse axis that is transverse to said longitudinal axis.

Suitably, said reflector can be a combination of one or more meander strips and at least one conductive plate. In one form, said meander strip and conductive plate may be preferably configured so that electric field components of said antenna are substantially summed in a direction parallel to a longitudinal axis thereof and cancelled in an transverse axis that are transverse to said longitudinal axis.

Suitably, said reflector is may be a conductive plate with one or more apertures therein.

Suitably, said reflector may consist of plurality of parallel conductive plates.

Preferably, the reflector may have a width that is greater than a width of said ground plane portion.

BRIEF DESCRIPTION OF THE DRAWINGS

In order that the invention may be readily understood and put into practical effect, reference will now be made to preferred embodiments as illustrated with reference to the accompanying drawings in which.

DETAILED DESCRIPTION OF PREFERRED EMBODIMENTS OF THE INVENTION

Figure 1:
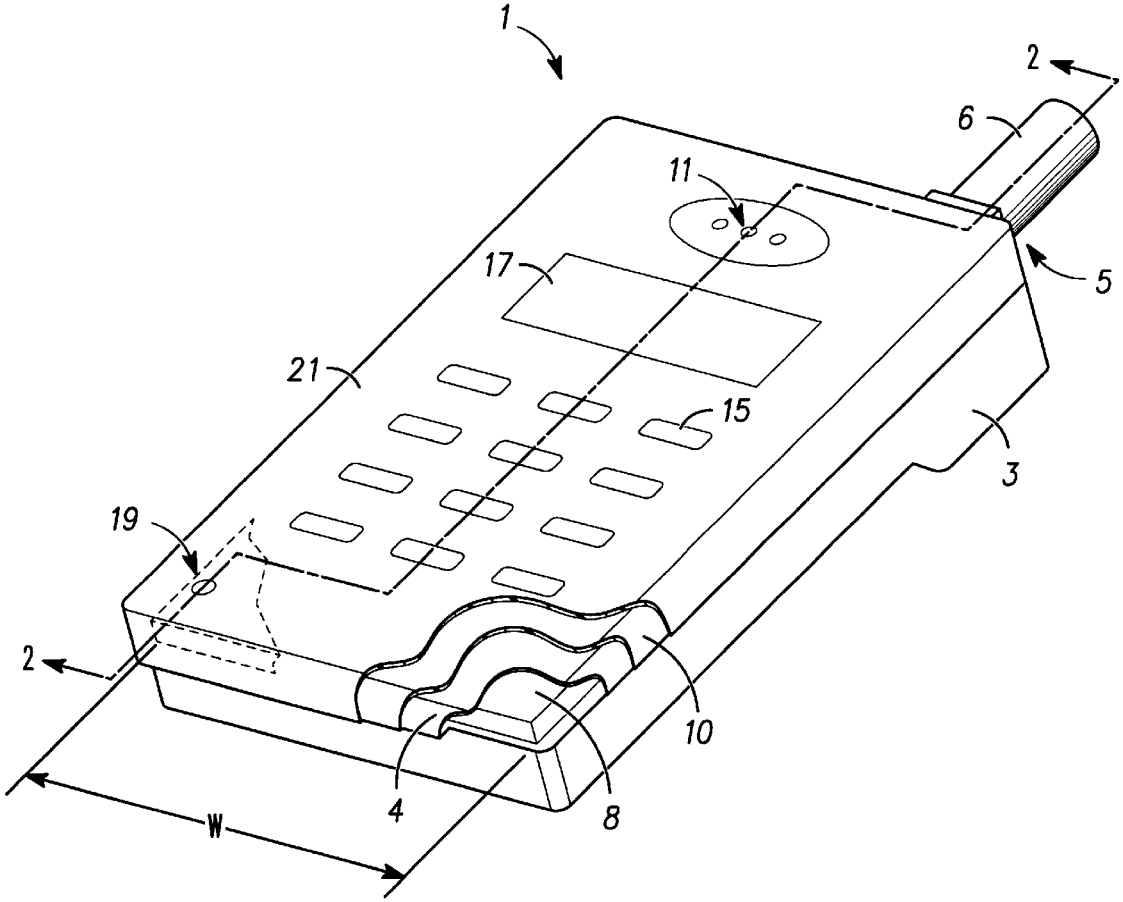
FIG. 1 is a perspective view illustrating a portable communication device, with a partially cut away portion, in accordance with a first embodiment the invention.
Figure 2:
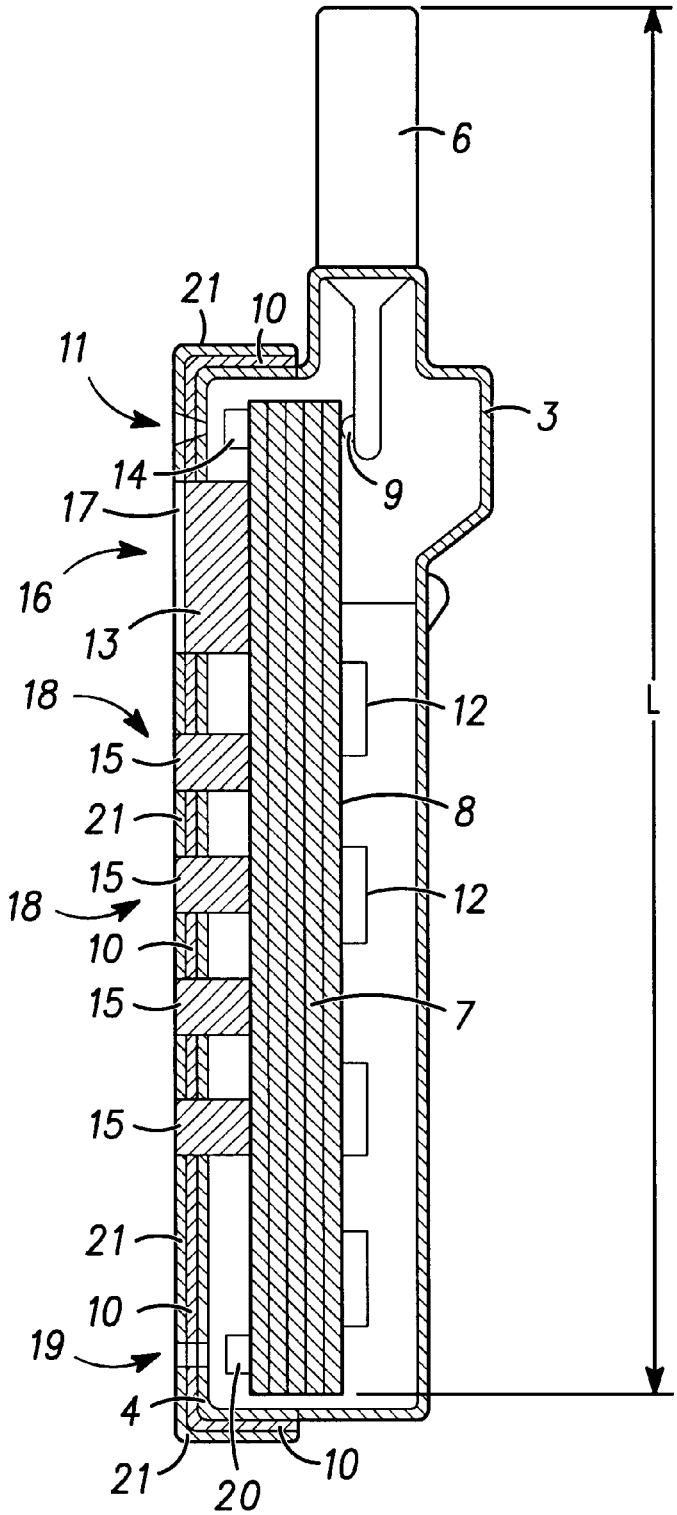
FIG. 2 is a cross sectional view, through 2—2, of the portable communication device FIG. 1.

Referring to FIGS. 1 and 2, there is illustrated a portable radio communication device in the form of a battery powered radio telephone 1 with a two part housing comprising a back housing 3 and front housing 4 mounted to each other by screws (not shown). The radio telephone 1 has an antenna 5 that is partially enclosed by the housing. The antenna 5 has a stub portion 6 extending from the housing and a ground plane portion 7 associated with a multi layer circuit board 8 (with an exaggerated thickness in the drawings).

As will be apparent to a person skilled in the art, ground plane portion 7 is typically a copper film disposed on the circuit board 8 which is enclosed and mounted in the housing by conventional means. The antenna 5 is asymmetrical about a feedpoint which in this embodiment is a spring 9 mounted to and protruding from part of stub portion 6. The spring 9 couples stub portion 6 to ground plane portion 7. Accordingly, the feedpoint or spring 9 is between the stub portion 6 and ground plane portion 7 and as clearly indicated the feedpoint or spring 9 is not positioned midway along a length L of antenna 5 and therefore antenna 5 is asymmetrical about the feedpoint or spring 9. The front housing 4 has an electrically conductive surface, in the form of a conductive spray paint coating disposed on outside surfaces of front housing 4, to provide a reflector 10. The reflector 10 is an electrically conductive shell that is electrically floating relative to the ground plane portion 7. The reflector 10 has a length that is at least half a wavelength ($\lambda/2$) of an intended lowest operating frequency of radio telephone 1. Covering the reflector 10 is an insulating spray paint 21 that electrically insulates reflector 10 from a user of radio telephone 1. As can be clearly seen, the width of the reflector 10 covers the front surface and sides of front housing 4 and therefore the width of reflector 10 is greater than the width W of ground plane portion 7.

Mounted on the circuit board 8 are interconnected electronic components 12, a liquid crystal display 13, speaker 14, a microphone 20, keypad keys 15 and associated keypad switch contacts (not shown). The front housing 4 has a speaker outlet 11 aligned with and proximal to speaker 14, and an area of reflector 10 is disposed on front housing 4 adjacent this speaker outlet 11. Front housing 4 also has an aperture 16 for accommodating a liquid crystal display lens 17, keypad apertures 18 through which the keypad keys 15 protrude and a microphone inlet 19 proximal to microphone 20.

Figure 3:
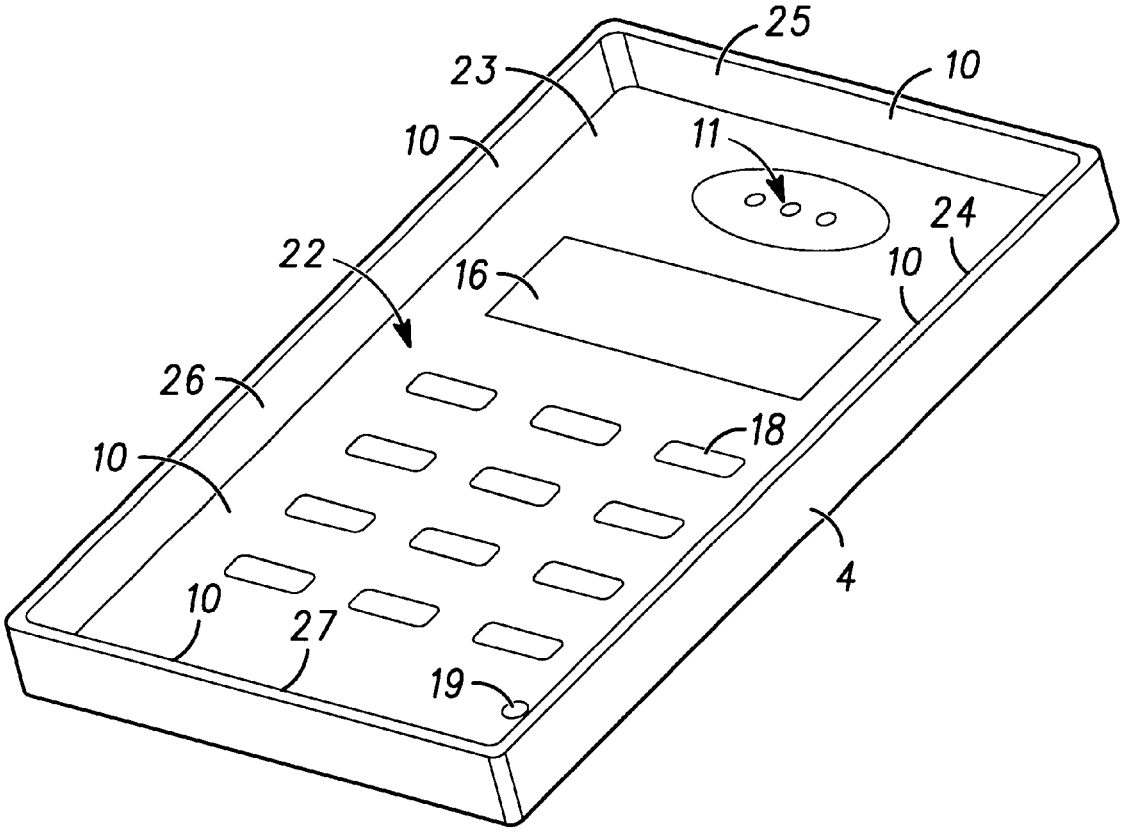
FIG. 3 is a perspective view illustrating a second embodiment of a reflector on inner surfaces of a front housing of the portable communication device of FIG. 1.

In FIG. 3, a second embodiment of a reflector 22 is illustrated in which an electrically conductive surface providing the reflector 22, in the form of an electrically conductive shell, is disposed on each of surfaces 23,24,25,26 and 27 of front housing 4.

The reflector 22 is an electrically conductive paint sprayed onto surfaces 23,24,25,26 and 27 providing a continuous conductive plate with apertures identified by numerals 11,16,18,19 therein. However, as will be apparent to a person skilled in the art, the reflector may be integrally molded into front housing 4 or it can be a metal plate enclosed in the housing. The reflector 22 is electrically floating relative to the ground plane portion 7 and the reflector 22 has a length that is at least half a wavelength ($\lambda/2$) of an intended lowest operating frequency of radio telephone 1. Ideally, to stop grounding of the reflector 10, for example by a user's body, the reflector 22 is enclosed by the housing and is therefore electrically insulated from a user. Further, as will be apparent to a person skilled in the art, the width of the reflector 22 covers the inside surface and sides of front housing 4 and therefore the width of reflector 22 is greater than the width W of ground plane portion 7.

Figure 4:
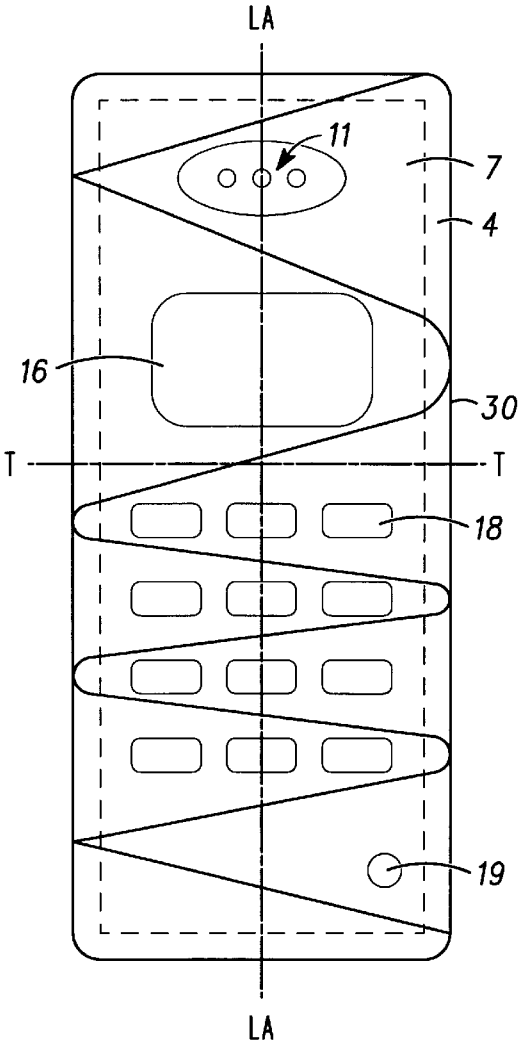
FIG. 4 is a third embodiment of a reflector in accordance with the invention.

In FIG. 4, a third embodiment of a reflector 30 is illustrated. The reflector 30 is again mounted by spray paint or otherwise to at least one inner surface 23 of front housing 4. The reflector 30 is in the form of a meander strip configured so that electric field components of the antenna 5, induced into reflector 30, are substantially summed in a direction parallel to a longitudinal axis LA of ground plane portion 7 (illustrated in phantom) and cancelled in an transverse axis T that is transverse to longitudinal axis LA. Typically, the meander strip is used when the length of front housing 4 is less than a length of at least ($\lambda/2$) of an intended lowest operating frequency of radio telephone 1.

Figure 5:
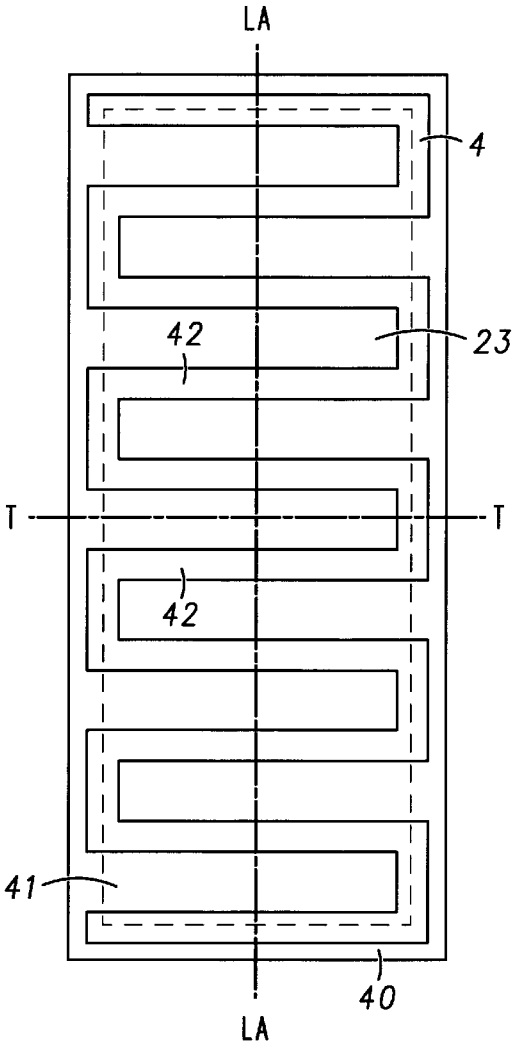
FIG. 5 is a fourth embodiment of a reflector in accordance with the invention.

In FIG. 5, a fourth embodiment of a reflector 40 is illustrated. The reflector 40 is etched onto a substrate 41 and enclosed in the housing and sandwiched between antenna 5 and front housing 4. As will be apparent to a person skilled in the art, the shape and dimensions of reflector 40 may be configured to allow for apertures to be inserted into substrate 41 for alignment and accommodation of components such as the keypad keys 15 and liquid crystal display 13. Alternatively, reflector 40 may be disposed on at least inner surface 23 of front housing 4 by spray paint or otherwise. The reflector 40 is in the form of meander strips having lengths 42 parallel to each other. The meander strips can be suitably configured so that electric field components of the antenna 5, induced into reflector 40, are substantially summed in a direction parallel to a longitudinal axis LA of ground plane portion 7 (illustrated in phantom) and cancelled in an transverse axis T that is transverse to longitudinal axis LA.

Figure 6:
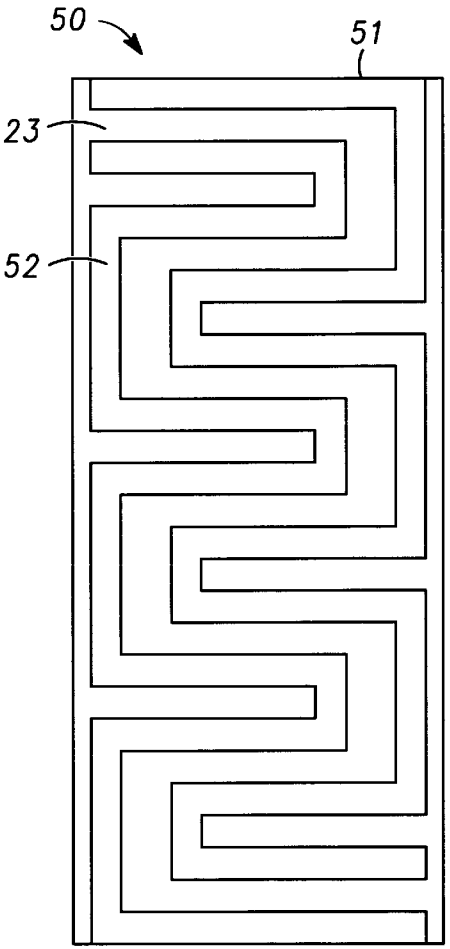
FIG. 6 is a fifth embodiment of a reflector in accordance with the invention.

In FIG. 6, a fifth embodiment of a reflector 50 is illustrated. The reflector 50 is typically disposed on at least surface 21 of front housing 4 by spray paint or otherwise. The reflector 50 is in the form of two complementary meander strips 51,52 accommodation of apertures 11, 16 and 18.

Figure 7:
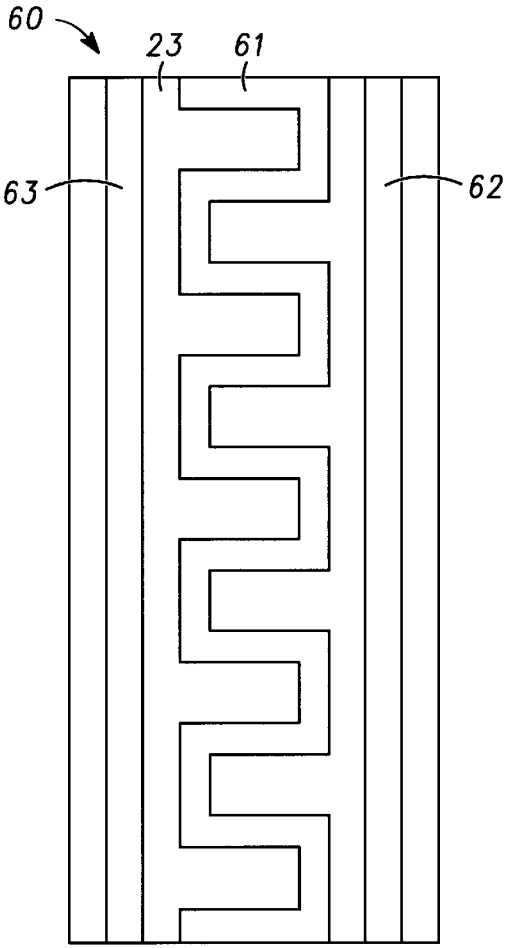
FIG. 7 is a sixth embodiment of a reflector in accordance with the invention.

In FIG. 7, a sixth embodiment of a reflector 60 is illustrated. The reflector 60 is typically disposed on at least surface 21 of front housing 4 by spray paint or otherwise. The reflector 60 is in the form of a meander strip 61 disposed between two parallel conductive plates 62,63. Again reflector 60 is configured for accommodation of apertures 11, 16 and 18.

Figure 8:
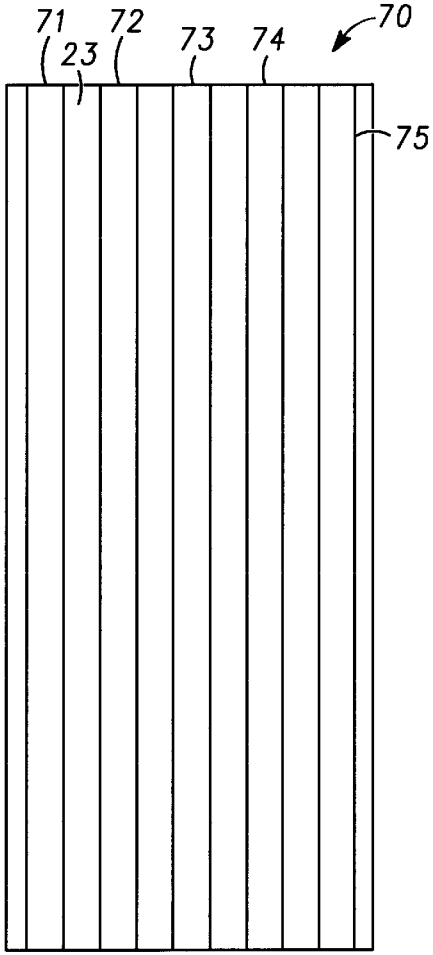
FIG. 8 is a seventh embodiment of a reflector in accordance with the invention.

In FIG. 8, a seventh embodiment of a reflector 70 is illustrated. The reflector 70 is typically disposed on at least surface 21 of front housing 4 by spray paint or otherwise. The reflector 70 is in the form of a plurality of parallel conductive plates 71,72,73,74,75. Again reflector 70 is configured for accommodation of apertures 11, 16 and 18.

Advantageously, the present invention provides for improved antenna radiation efficiency radio telephone 1. This therefore allows lower power consumption when transmitting signals to a base station or cell. Accordingly, talk time of the radio telephone 1 for a specific battery is increased. Furthermore, the invention allows for the possibility of receiving signals when the radio telephone 1 is in poor radio reception areas. Another advantage of the present invention is that when the width of reflector is greater than the width W of ground plane portion 7 and therefore induced current densities in the reflector are reduced Although the invention has been described with reference to preferred embodiments, it is to be understood that the invention is not restricted to the embodiments described herein. For example, the invention can be used for two-way radios and the meander strips may be any desired shape or configuration that allows for electric field components of the antenna 5 to be substantially summed in a direction parallel to its longitudinal axis L and cancelled in an transverse axis T that is transverse to longitudinal axis L.

We claim:

1. A portable radio communication device with improved antenna radiation efficiency, said radio communication device comprising:

an antenna asymmetrical about a feedpoint thereof;

a housing at least partially enclosing said antenna; and an electrically conductive surface providing a reflector for said antenna, said reflector having a length that is at least half a wavelength of an intended lowest operating frequency of said radio communication device.

2. A portable radio communication device as claimed in claim 1, wherein said antenna has a stub portion extending from said housing.

3. A portable radio communication device as claimed in claim 2, wherein said antenna has a ground plane portion associated with a circuit board enclosed in said housing, and wherein said feedpoint is between said stub portion and said ground plane portion.

4. A portable radio communication device as claimed in claim 3, wherein said reflector is electrically floating relative to said ground plane.

5. A portable radio communication device as claimed in claim 3, wherein said reflector is disposed on said housing.

6. A portable radio communication device as claimed in claim 5, wherein said reflector is disposed on a surface of said housing adjacent a speaker outlet thereof.

7. A portable radio communication device as claimed in claim 6, wherein said reflector is disposed on said surface and at least one side surface of said housing.

8. A portable radio communication device as claimed in claim 6, wherein said reflector is disposed on every side surface of said housing to provide an electrically conductive shell.

9. A portable radio communication device as claimed in claim 5, wherein said reflector is in the form of a meander strip.

10. A portable radio communication device as claimed in claim 9, wherein said meander strip is configured so that electric field components of said antenna that are induced into said reflector are substantially summed in a direction parallel to a longitudinal of said ground plane portion and cancelled in an transverse axis that is transverse to said longitudinal axis.

11. A portable radio communication device as claimed in claim 5, wherein said reflector is in the form of meander strips having lengths parallel to each other.

12. A portable radio communication device as claimed in claim 11, wherein said meander strips are configured so that electric field components electric field components of said antenna that are induced into said reflector are substantially summed in a direction parallel to a longitudinal of said ground plane portion and cancelled in an transverse axis that is transverse to said longitudinal axis.

13. A portable radio communication device as claimed in claim 5, wherein said reflector is combination of one or more meander strips and at least one conductive plate.

14. A portable radio communication device as claimed in claim 13, wherein said meander strip and conductive plate are configured so that electric field components of said antenna are substantially summed in a direction parallel to a longitudinal axis thereof and cancelled in an transverse axis that are transverse to said longitudinal axis.

15. A portable radio communication device as claimed in claim 5, wherein said reflector is a conductive plate with one or more apertures therein.

16. A portable radio communication device as claimed in claim 5, wherein said reflector consist of plurality of parallel conductive plates.

17. A portable radio communication device as claimed in claim 3, wherein said reflector is integrally molded in said housing.

18. A portable radio communication device as claimed in claim 3, wherein said reflector has a width that is greater than a width of said ground plane portion.

19. A portable radio communication device as claimed in claim 1, wherein said reflector is a conductive plate.

20. A portable radio communication device having a lowest operating frequency, comprising:

an antenna asymmetrical about a feedpoint thereof;

a housing at least partially enclosing said antenna; and an electrically conductive meander strip reflector disposed on said housing and having a length that is at least half a wavelength of the lowest operating frequency.

21. A portable radio communication device as claimed in claim 20, a ground plane having a longitudinal axis, said reflector electrically floating relative to the ground plane, said meander strip aligned so that electric field components of said antenna that are induced into said reflector are substantially summed in a direction parallel to the longitudinal axis of said ground plane and cancelled in transverse direction to said longitudinal axis of said ground plane.

22. A portable radio communication device having a lowest operating frequency, comprising:

an antenna asymmetrical about a feedpoint thereof;

a housing at least partially enclosing said antenna; and at least one meander strip reflector and a ground plane disposed on said housing, said reflector strip having a length at least one-half a wavelength of the lowest operating frequency of said radio communication device, said reflector is electrically floating relative to said ground plane.

* * * * *